US011452893B2

(12) United States Patent
Falgares et al.

(10) Patent No.: US 11,452,893 B2
(45) Date of Patent: Sep. 27, 2022

(54) FALL RESTRAINT SYSTEM FOR ROOF WORK

(71) Applicant: NED STEVENS GUTTER CLEANING AND GENERAL CONTRACTING OF NEW JERSEY, LLC, Fairfield, NJ (US)

(72) Inventors: Marc Falgares, Middlesex, NJ (US); Robert Rapuano, Caldwell, NJ (US); Carlos Gonzales, Clifton, NJ (US)

(73) Assignee: NED STEVENS GUTTER CLEANING AND GENERAL CONTRACTING OF NEW JERSEY, Fairfield, NJ (US)

( * ) Notice: Subject to any disclaimer, the term of this patent is extended or adjusted under 35 U.S.C. 154(b) by 146 days.

(21) Appl. No.: 16/534,250

(22) Filed: Aug. 7, 2019

(65) Prior Publication Data

US 2020/0047008 A1 Feb. 13, 2020

Related U.S. Application Data

(60) Provisional application No. 62/717,559, filed on Aug. 10, 2018.

(51) Int. Cl.
*A62B 35/00* (2006.01)
*E04G 21/32* (2006.01)

(52) U.S. Cl.
CPC ..... *A62B 35/0075* (2013.01); *A62B 35/0068* (2013.01); *E04G 21/3214* (2013.01)

(58) Field of Classification Search
CPC ..... A62B 35/0075; A62B 35/0068; E04G 21/3214
See application file for complete search history.

(56) References Cited

U.S. PATENT DOCUMENTS 2,312,583 A * 3/1943 Penlon ..... B66D 3/00 182/6
4,633,974 A * 1/1987 Weiner ..... E04G 21/3276 182/12

(Continued)

FOREIGN PATENT DOCUMENTS

AU 2009100735 A4 9/2009
DE 2341619 A1 2/1975

OTHER PUBLICATIONS

The International Search Report and the Written Opinion of the International Searching Authority issued in corresponding international application No. PCT/US/19/45462, dated Oct. 28, 2019.

(Continued)

*Primary Examiner* — Colleen M Chavchavadze
(74) *Attorney, Agent, or Firm* — Day Pitney LLP; Anthony A. Kassas

(57) ABSTRACT

A fall restraint for a worker on a roof comprising a yoke line, wherein a first end of the yoke line is releasably connected to a first building structure and a second end of the yoke line is releasably connected to a second building structure. The fall restraint also comprises a support line, wherein a first end of the support line is slidably connected to the yoke line, and a second end of the support line is connected to a worker harness, wherein the support line is adapted to travel over a ridge line of the roof and at least partially support the weight of the worker.

14 Claims, 8 Drawing Sheets

(56) References Cited

U.S. PATENT DOCUMENTS

| | | | | |
|---|---|---|---|---|
| 5,036,949 | A * | 8/1991 | Crocker | E04G 21/3261 248/231.71 |
| 5,287,944 | A * | 2/1994 | Woodyard | A62B 35/04 182/3 |
| 5,730,407 | A * | 3/1998 | Ostrobrod | A62B 35/0043 248/237 |
| 6,098,746 | A * | 8/2000 | Castaneda | E04G 21/3214 182/45 |
| 6,112,853 | A | 9/2000 | Beard | |
| 6,533,066 | B1 * | 3/2003 | O'Dell | A62B 35/04 182/3 |
| 8,292,030 | B2 | 10/2012 | Ballantyne | |
| 8,789,655 | B2 * | 7/2014 | Dowie | A62B 35/0093 182/234 |
| 9,175,437 | B2 * | 11/2015 | Gamba | D07B 1/24 |
| 9,248,323 | B1 * | 2/2016 | Larsen | E04G 21/3261 |
| 9,272,167 | B2 * | 3/2016 | Smit | A62B 35/0043 |
| 10,060,146 | B2 * | 8/2018 | Simmons | A62B 35/0081 |
| 10,238,899 | B1 * | 3/2019 | Sherman | E04G 21/3276 |
| 10,926,115 | B2 * | 2/2021 | Ettling | B64F 5/40 |
| 2008/0042030 | A1 * | 2/2008 | Holling | E04G 21/3261 248/237 |
| 2012/0312633 | A1 * | 12/2012 | Massey | A62B 35/0068 182/3 |
| 2013/0062145 | A1 * | 3/2013 | Inoue | A62B 35/0068 16/400 |
| 2014/0060967 | A1 * | 3/2014 | Patton | A62B 35/0068 182/3 |
| 2014/0339016 | A1 * | 11/2014 | Hopkins | A62B 35/0068 248/237 |
| 2016/0194890 | A1 * | 7/2016 | Landry | A62B 35/0068 248/237 |

OTHER PUBLICATIONS

"EM 0221-5ORG Vertical Rope Lifeline with Double Locking Snap Hook and Rope Adjuster, 50 feet" (3M) [online] (retrieved from the internet on Mar. 10, 2019) < URL https://www.amazon.com/3M-0221-5ORG-Vertical-Lifeline-Adjuster/dp/BOOKCQHBSG/ref=cm_cr_arp_d_product_top?ie-=UTF8 > Oct. 12, 2016 (Oct. 12, 2016), entire document, especially Specifications for this item table and product description.

International Preliminary Report on Patentability issued in corresponding international application No. PCT/US2019/045462 with Amended Sheets of drawings, dated Oct. 1, 2020. (23 pages).

* cited by examiner

FALL RESTRAINT SYSTEM FOR ROOF WORK

RELATED APPLICATIONS

This application claims priority to U.S. Provisional Application Ser. No. 62/717,559, filed Aug. 10, 2018, the disclosure and teaching of which is incorporated by reference herein.

BACKGROUND OF THE INVENTION

1. Field of the Invention

The invention disclosed herein relates to safety equipment, and in particular, to rigging methods and apparatus for providing fall restraint to individuals working on roof tops.

2. Description of the Related Art

Anyone who has had to walk on a roof knows that doing so is a dangerous proposition. Occupational Safety and Health Administration's ("OSHA") regulations have attempted to address the risk associated with the fall hazard. Generally, any worker engaged in work above a certain height must follow conventional fall protection system regulations. Personal fall arrest systems are typically secured to the roof through the property owner's roof shingles via a roof anchor with penetrating holes that could result in water damage, or such systems are assembled on the ground with the use of heavy counterweights that are cumbersome, time consuming to install, and can be dangerous to use. The system must be secured such that if the worker were to slip, the worker would be safely caught and not fall to the ground. The requirement for fall protection is difficult to implement in many industries.

For residential contractors performing various tasks that require roof entry, providing fall restraint systems with adequate physical strength has typically required attachment of anchoring systems directly to the residence as described above. These systems can be costly in terms of time and materials. Further, most home owners do not want holes drilled into roofing. Thus, providing adequate securement has been a challenge. The other option involved heavy counterweight systems described above which are difficult to transport, cannot be used on many scenarios like on sloped land, and can be costly, provide less flexibility and be time consuming.

What are needed are methods and apparatus for providing contractors with improved fall restraint systems. Preferably, the methods and apparatus result in systems that may be set up quickly, are easy to implement and may be removed and reused.

SUMMARY OF THE INVENTION

A fall restraint for a worker on a roof comprising a yoke line, wherein a first end of the yoke line is releasably connected to a first building structure and a second end of the yoke line is releasably connected to a second building structure. The fall restraint also comprises a support line, wherein a first end of the support line is slidably connected to the yoke line, and a second end of the support line is connected to a worker harness, wherein the support line is adapted to travel over a ridge line of the roof and at least partially support the weight of the worker.

The support line is configured to travel freely along the yoke line as the worker moves laterally along the roof. The yoke line is configured to create a reduction in tension in the support line by means of a tangential force perpendicular to the support line as the support line travels over the ridge of the roof. The reduction in tension is configured to increase as the angle from center axis increases, and the preferred angle from center axis is between 0 and 41 degrees.

BRIEF DESCRIPTION OF THE DRAWINGS

The features and advantages of the invention are apparent from the following description taken in conjunction with the accompanying drawings in which.

DETAILED DESCRIPTION OF THE INVENTION

Disclosed herein are methods and apparatus for providing a fall restraint system. Generally, the fall restraint system is provided for individuals engaged in activities which require an entry to the roof of a building for a limited duration of time. Activities may include, for example and without limitation, installation and/or repair of roofing material, cleaning and/or installation of rain gutters, installation and/or repair of siding material, and chimney work. In the examples disclosed herein, the building is a residence configured with rain gutters. The rain gutters are attached to a fascia of the building with a series of anchors known as gutter hangers.

Figure 1:
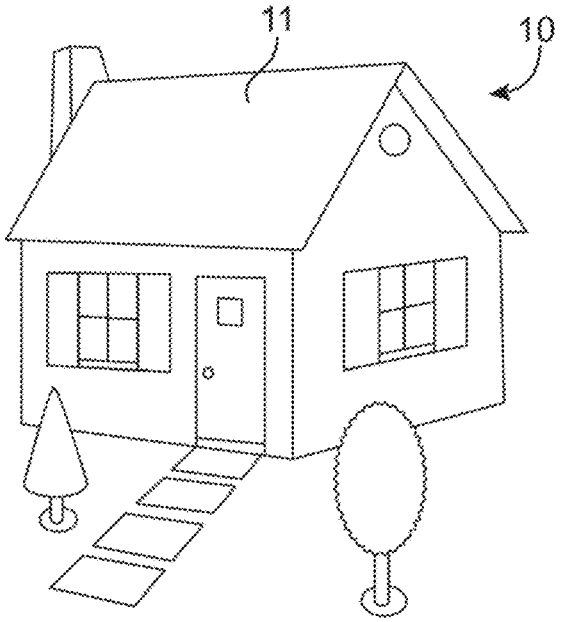
FIG. 1 is an schematic diagram depicting a residential property.
Figure 2:
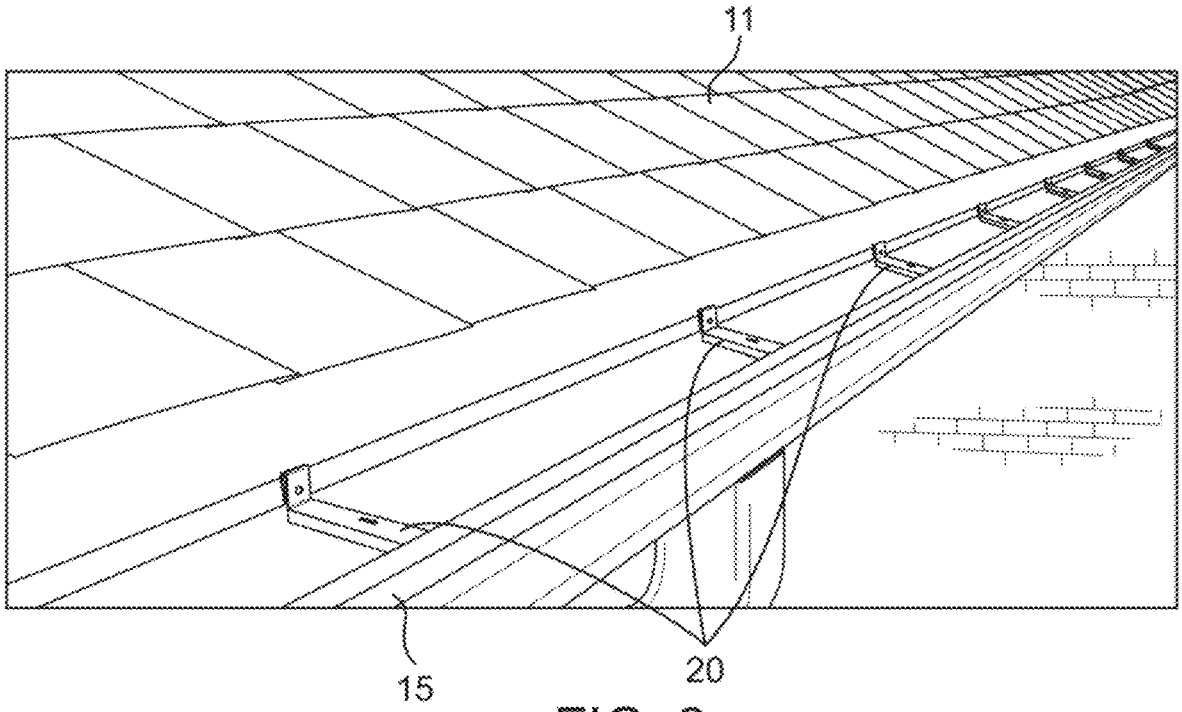
FIG. 2 is a perspective diagram depicting aspects of a gutter system for the residential property of FIG. 1.
Figure 6:
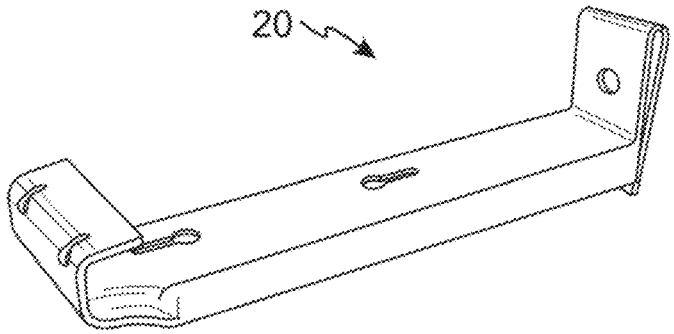
FIG. 6 is a front perspective view of a gutter hanger for use in the fall restraint system according to the teachings herein.

Referring now to FIG. 1, an exemplary embodiment of a residential property (referred to herein as a "building 10") is shown. The building 10 includes a pitched roof 11. For purposes of the present invention, pitched roof 11 preferably includes various pitch slopes up to a 10/12 pitch slope with a 39.81% angle measurement. As shown in FIG. 2, along a lower edge of the roof 11 is a gutter 15. Generally, the gutter 15 catches precipitation and directs the precipitation away from the foundation of building 10. The building 10 may have gutters 15 disposed on one or more sides thereof In this illustration, the gutter 15 is attached to the building by a series of gutter hangers 20 which act as anchors. An example of an gutter hanger 20 can be seen in FIG. 6.

Generally, the gutter hangers 20 are secured through a fascia board (not shown) which is attached to, and forms a part of, building 10. The gutter hanger 20 are securely attached and capable of carrying the weight of the gutter 15, which may not be insubstantial. For example, a typical gutter 15 has a cross section of 3.5 inches by 5 inches. If a twenty foot section is filled with water, this will weigh approximately 150 pounds, while a thirty foot section filled with water will weigh approximately 227 pounds. This could weigh substantially more when laden with ice. Thus, it is a requirement that each gutter hanger 20 be sturdy and reliable when installed.

Figure 3:
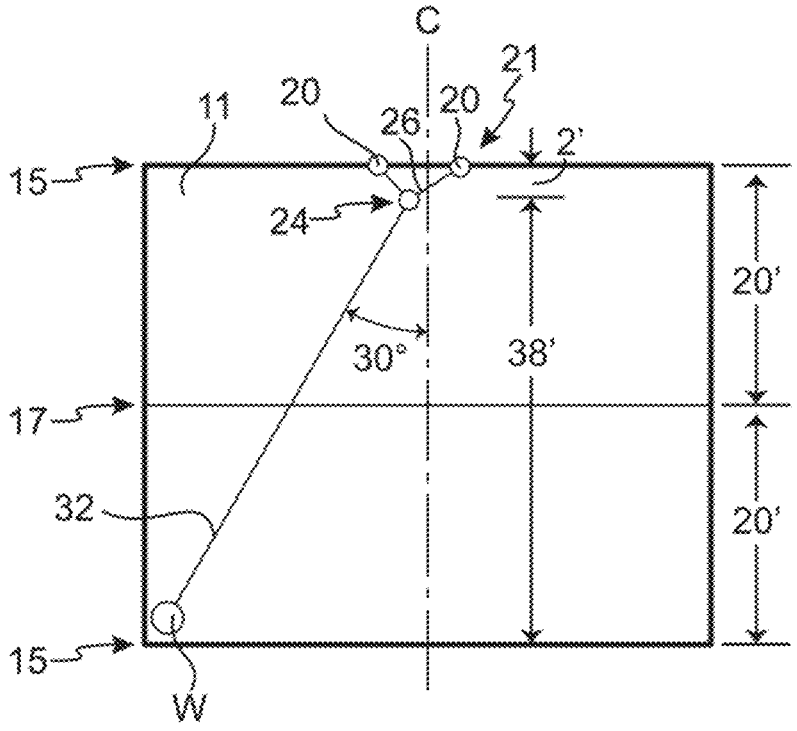
FIG. 3 is a top-down schematic diagram of the residential property of FIG. 1, the diagram depicting aspects of an installation of a fall restraint system according to the teachings herein.
Figure 10:
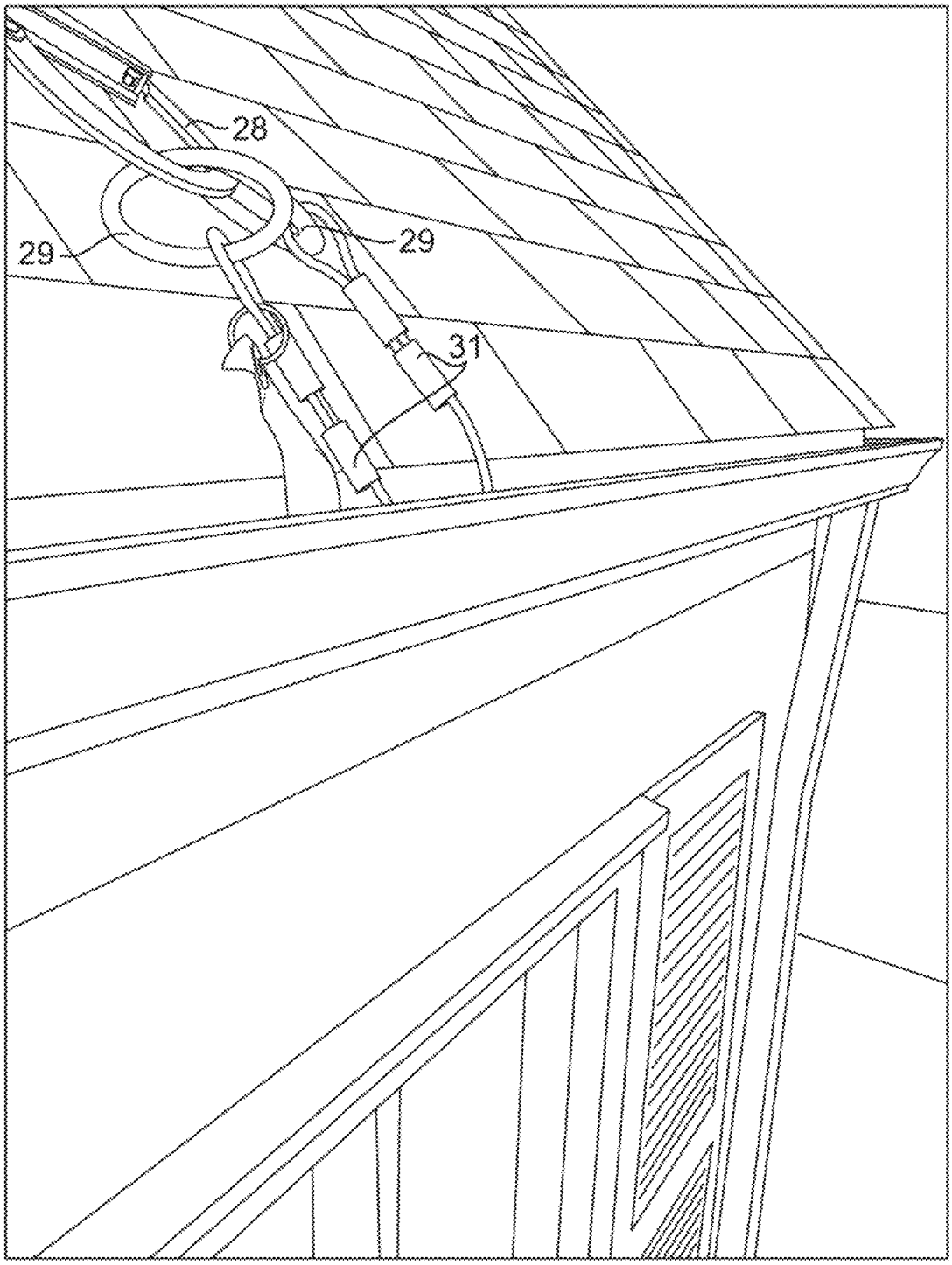
FIGS. 10-12 show the fall restraint system of the claimed invention in use on a residential property.
Figure 11:
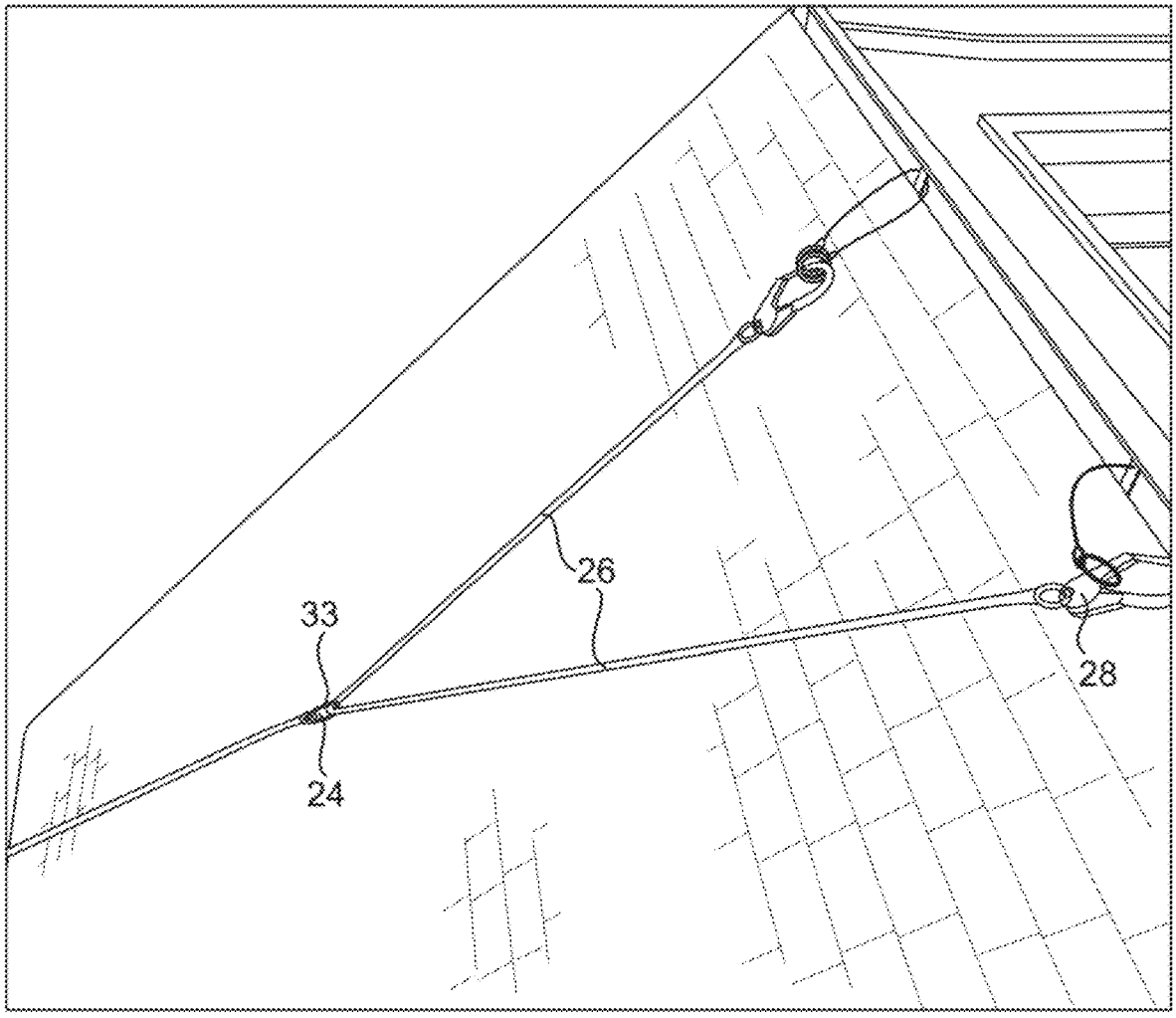
Figure 12:
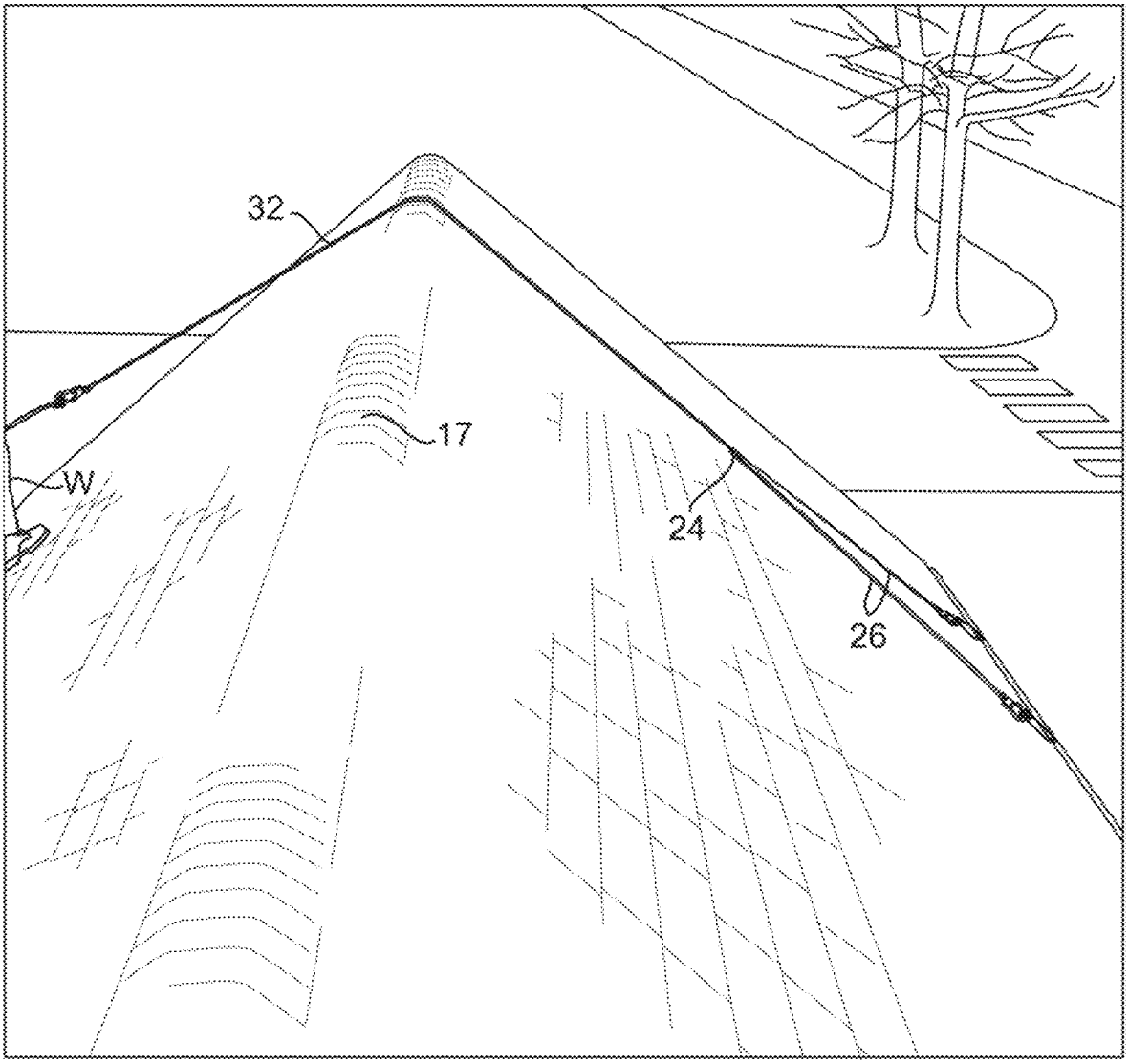

Turning to FIG. 3, an exemplary installation of a system according to the teachings herein is shown. The system includes a yoke line 26 and a support line 32. In a preferred embodiment, the support line 32 is a vertical lifeline. Generally, the yoke line 26 will attach to one or more anchor lines 31 via a clamp 28 attached at the end of the yoke line 26. As seen in FIGS. 10-12, each of the two anchor lines 31 is wrapped around and/or otherwise secured to a gutter hanger 20 and each end of the yoke line 26 is connected to an anchor line 31 via the clamp 28 which is attached to each end of the yoke line 26. Generally, the anchor lines 31 include an additional length of material to provide for some slack between the gutter hangers 20. Preferably, anchors lines 31 can be three-foot, 5/16-inch thick steel vinyl coated cables which contain O-rings 29 to which clamps 28 are attached. Generally, the support line 32 attaches to the yoke line 26, and is preferably slidably connected to the yoke line 26. The support line 32 may travel freely along the yoke line 26. For example, the support line 32 may be attached to the yoke line 26 at yoke point 24 by means of a carabiner or snap hook 33, configured to slide along yoke line 26 without releasing from the same. In a preferred embodiment, clamp 28 can be a rebar hook or a carabiner. Preferably, each anchor line 31 comprises two O-rings 29, one on each end thereof, whereby both O-rings 29 connect to clamp 28 after the anchor line 31 has been wrapped around a gutter hanger 20. This can be seen in FIG. 10. Therefore, in a preferred embodiment, each end of yoke line 26 comprises a clamp 28 which is secured to two O-rings 29, each of which is attached to one end of anchor line 31 which secures to a gutter hanger 20. Stated differently, the preferred embodiment comprises one yoke line 26, two clamps 28, four O-rings 29, and two anchor lines 31. Of course, it is envisioned within the scope of the invention that different amounts of clamps 28, O-rings 29, or anchor lines 31 could be utilized.

Once installed, the support line 32 is placed over the ridge 17 of the roof 11. At the opposing end of the support line 32, the worker W is provided with a coupling for coupling a conventional harness, such as the LITEFIT Positioning Harness, Tongue Buckle Legs (M/L). Once properly configured, the worker W may freely move about the side of the roof 11 that opposes the connection side where the gutter hangers 20 reside.

FIG. 3 shows an example of a basic layout of a typical pitched roof with the fall restraint system in place. In the example shown, the footprint of the house is symmetric at 20 feet on each side of the ridge 17. Two attachment points 21 along the gutter on one side of the house are shown and joined at a point known here simply as the "yoke" 24, whereby yoke 24 is the point at which yoke line 26 connects along the roof to support line 32, preferably by means of carabiner or snap hook 33. The yoke line 26 is attached at both ends to respective attachment points 21 on gutter 15 (preferably by means of anchor lines 31, O-rings 29, and clamp 28). In this example, the yoke 24 is located approximately two feet up the roof from one eave/gutter 15 with the attachment points 21 (and thus thirty-eight feet up the roof from the other gutter 15). In a preferred, non-limiting embodiment, the yoke line 26 is a 15-foot, 5/8 inch polyester/polypropylene blend rope with two rebar hook ends. In the example seen in FIG. 3, the support line 32 is shown at 30 degrees of arc from the center axis C of roof 11. In a preferred, non-limiting embodiment, the support line 32 is a 50-foot, 5/8 inch polyester/polypropylene blend rope, and preferably has a manual rope adjustor with 18" lanyard restraint secured to a harness buckle.

Figure 4:
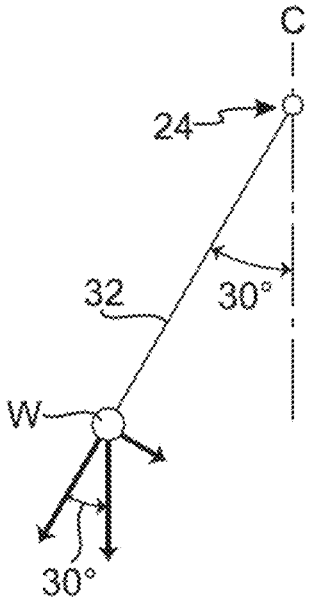
FIG. 4 is a vector diagram depicting aspects of geometry and forces applied in the system of FIG. 3.

FIG. 4 is a schematic representation of the force vectors that may result from the initiation of a slippage incident, i.e., an occurrence in which the worker W starts to slip or slide across the surface of the roof 11 due to gravity, to prevent the worker W from falling and maintain safety and positioning as a result of the present invention fall restraint system. The present invention fall restraint system is designed to utilize multiple points of contact with a roof 11 to reduce tension in the rope support for a worker W and thereby stabilize the worker W in case of a slipping, tripping, or falling incident, and reduce the risk of the support failing to hold the worker's body weight. To do this, the present invention utilizes multiple attachment points 21 on the gutter hangers 20 of a gutter 15, to which anchor lines 31 are connected, and a yoke 24 which joins an initial rope segment (yoke line 26, which is connected on each end to anchor lines 31), and transfers tension to a new rope (support line 32), which then crosses and leans on ridge 17 of roof 11 before eventually connecting to worker W. Through all of this, the tension in support line 32 is designed to be is lower than the direct force of weight plus momentum.

Specifically, for the example shown in FIG. 4, where a worker is at a 30 degree angle off of center axis C from the yoke position, the tension is proportional to the cosine of 30 degrees, or approximately 87% of the tension of the same support line 32 in a slippage or tripping incident had the worker W been at a center axis C position aligned across the roof 11 with the yoke 24. Through the configuration of the present invention, the tension percentage is designed to decrease proportionally as the angle of the worker W off of the center axis C, and continues to decrease as the angle increases. Note that the forces shown in FIG. 4 only come in to existence if and when a worker W starts in motion as would happen if a slippage incident is initiated and the rope is being used as a restraint. In a preferred embodiment, the angle from center axis C is between 0 and 41 degrees.

Figure 5:
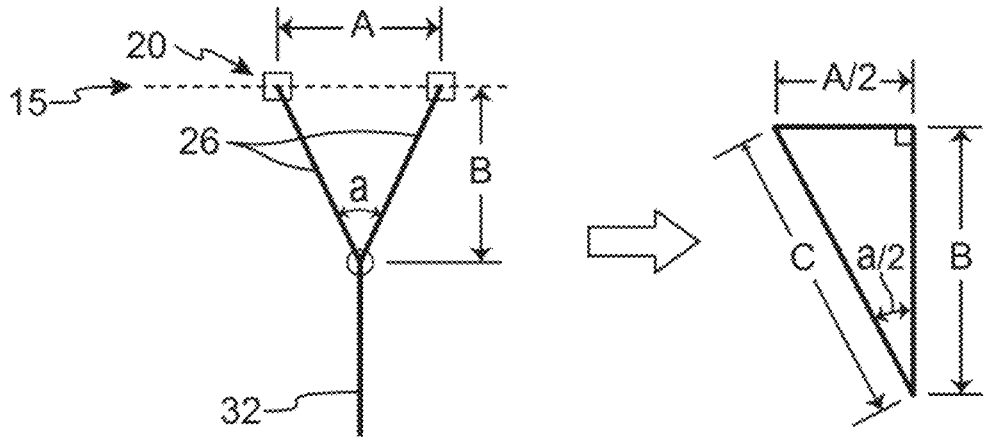
FIG. 5 is a diagram depicting aspects of geometry and forces applied in the system of FIGS. 3 and 4.
Figure 7:
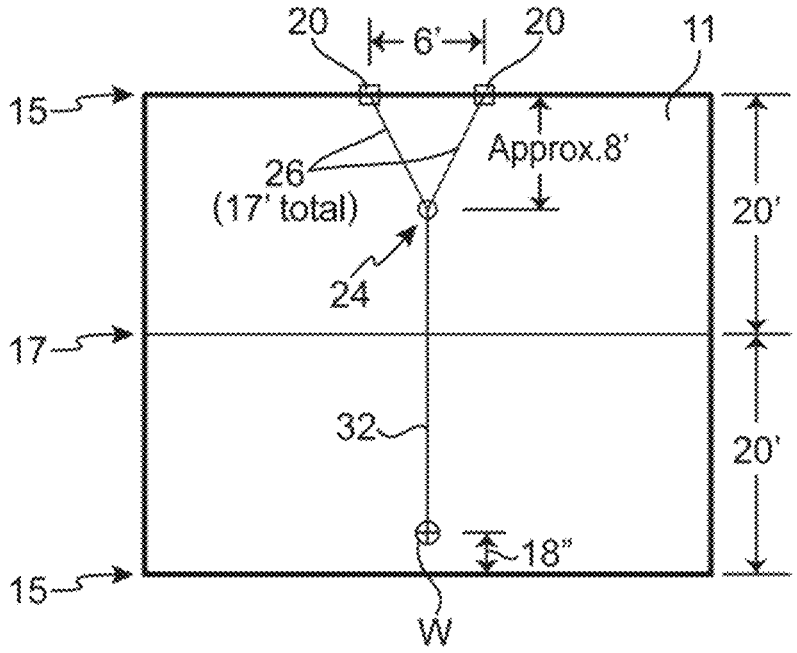
FIG. 7 is top-down schematic diagrams of the residential property of FIG. 1, the diagram depicting aspects of an installation of a fall restraint system according to the teachings herein, with worker at center position with respect to the fall restraint system.
Figure 8:
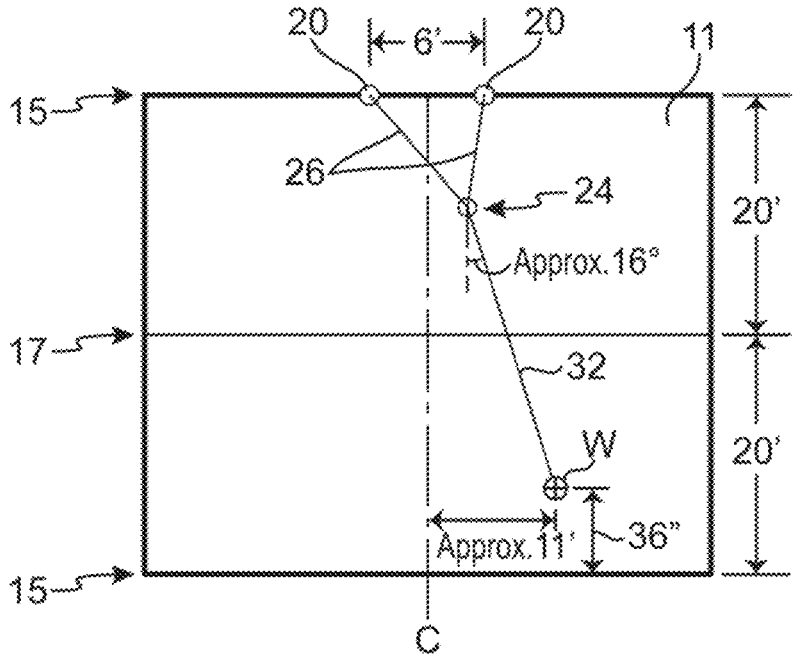
FIG. 8 is top-down schematic diagrams of the residential property of FIG. 1, the diagram depicting aspects of an installation of a fall restraint system according to the teachings herein, with worker at an extended lateral position with respect to the fall restraint system.

FIGS. 5, 7, and 8 are diagrams depicting aspects of geometry and force vectors, showing preferred embodiments of the invention whereby the support line 32 is designed to hold a worker W at an angle from center axis C, which is aligned with yoke 24 along the roof 11. FIG. 7 is diagram of a typical roof layout with the worker W at a center axis C on roof 11 with respect to yoke 24. The example in FIG. 7 provides a plan view of pitched roof 11 showing worker W along center axis C and aligned with yoke 24, with a center of gravity that is eighteen inches from the edge. FIG. 8 is a diagram of a typical roof layout with the worker W at a laterally extended work position on roof 11 with respect to yoke 24, with a center of gravity that is thirty-six inches from the edge. This indicates an 18-inch working range up and down the roof (18 to 36 inches), and a 22-foot horizontal range (e.g., up to 11 feet laterally on either side of the center axis C). The examples shown in FIGS. 7-8 are only exemplary, and actual horizontal extension will depend on actual roof dimensions and pitch.

These and other aspects are evaluated when considering loading and capabilities of the fall restraint system disclosed herein. These aspects are discussed further with regard to FIG. 9, in which a flow chart depicting an exemplary method for set-up and use of the fall restraint system is provided.

Figure 9:
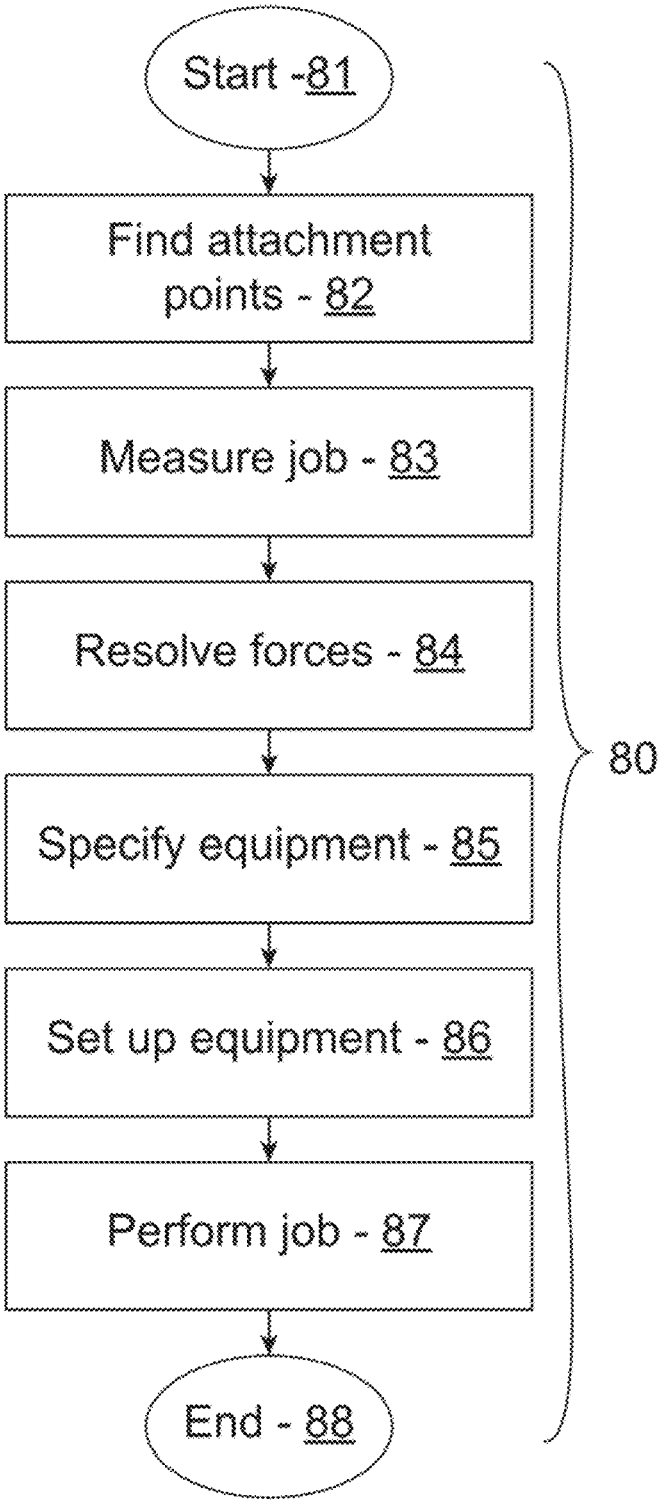
FIG. 9 is a flow chart depicting an exemplary method for implementation of the system disclosed herein.

As seen in FIG. 9, a process for employing the fall restraint system 80 of the present invention is provided, starting at a job site 81. Once at the job site, the worker W finds potential attachment points 82 on the roof 11. While the attachment points may be gutter hangers 20, and typically are, other features of the building 10 may be used.

Once the worker W finds potential attachment points 82, the distance between the attachment points 82 is measured, along with dimensions of the roof 11 and a zone within which the worker W shall be working, preferably across the ridge 17 on the roof 11. Additionally, inspection of the attachment points 82 is preferably performed, and appropriate documentation, such as safety forms, are provided. The dimensional information (such as those depicted in FIGS. 3-5), along with other aspects such as a weight of the worker W, are used to resolve forces 84 and perform loading calculations. Generally, the loading calculations evaluate the aspects input and derive force vectors, which are then used to specify equipment 85 by identifying any limitations or additional requirements for the fall restraint system to support worker W at the particular angles off of center axis C that he/she may be working. Once the equipment for the particular installation of fall restraint system equipment has been specified, the worker W will set up the fall restraint system equipment 86 and then perform the job 87. Once the work is completed, the fall restraint system equipment is removed and the process ends 88. It is envisioned within the scope of the present invention that the order of steps presented in FIG. 9 could be accomplished in alternate orders.

FIGS. 10-12 show exemplary images of the fall restraint system of the present invention in practice on a roof 11, showing anchor lines 31 wrapped around gutter hangers 20, and connected on both ends to clamps 28 by means of O-rings 29. Clamps 28 are in turn attached to yoke line 26 and then to support line 32 at yoke 24 by means of carabiner or snap hook 33. From yoke 24, support line 32 extends over ridge 17 and to worker W.

Having thus introduced embodiments of the fall restraint system, some additional aspects are now presented.

Specifications for the fall restraint system may be determined manually or with a computer or calculator. In another aspect of the invention, a proprietary computer software system can be utilized in connection with the presentation invention. The computer system can be utilized by workers at a job site, and can ensure proper use of the fall restraint system of the claimed invention. Additionally, the software can allow supervisors in the field to assess the safety performance of workers in the field through a series of scores assigned to a variety of itemized requirements, and an opportunity to input findings during inspections which can be stored for future use and tracked via reporting which can alert a supervisor if the system of the present invention is not being used properly. It is also envisioned that the software program could identify workers checked into a job site through electronic signature verification, and record any commendations or discipline issues as a result of the spot checks. This information is gathered and stored for future use and to track success and failures of crews. It is envisioned that the computer software could also be used to train workers on the proper method for utilizing the present invention.

In another embodiment, a measurement system may be used in conjunction with the software system, and implemented with a computer outfitted with a camera. For example, a smartphone may implement an application (an "app") that receives images from an on board camera and calculates distances according to known features (such as, for example, a width of a clapboard, a brick size, a known standard or some other similar feature). The computer may generate a report with appropriate detail needed for the various interested parties. For example, reports may include: specifications for the fall restraint system specified for a particular work-site; excerpts of applicable regulations; a customer report; an insurer report and other types of reports. The system may be interactive, and include, for example, a statement for worker acknowledgement of system design and limitations. In some embodiments, the measurement system can be provided as a tablet computer in which the user inputs measurements manually. In some other embodiments, the measurement system can include specialized components, such as an integrated laser measurement tool and/or a sonic measurement tool in communication with the tablet computer through a wireless link. In some embodiments, the measurement system can be used with a computer system that provides an accessory to the fall restraint system. The accessory enables workers to check off procedure lists and enables reporting from the field. In short, the accessory enables compliance with safety procedures, training, reporting and enforcement.

Various other components may be included and called upon for providing for aspects of the teachings herein. For example, additional materials, combinations of materials and/or omission of materials may be used to provide for added embodiments that are within the scope of the teachings herein.

A variety of modifications of the teachings herein may be realized. Generally, modifications may be designed according to the needs of a user, designer, manufacturer or other similarly interested party. The modifications may be intended to meet a particular standard of performance considered important by that party.

When introducing elements of the present invention or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements. As used herein, the term "exemplary" is not intended to imply a superlative example. Rather, "exemplary" refers to an embodiment that is one of many possible embodiments.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fall restraint for a worker on a roof, comprising:

a yoke line, a first end of the yoke line configured for releasable connection to a first pre-existing gutter hanger and a second end of the yoke line configured for releasable connection to a second pre-existing gutter hanger;

two or more anchor lines configured to secure the yoke line to the first and second pre-existing gutter hangers, each anchor line comprising two O-rings configured to secure to one of the first and second ends of the yoke line; and a support line, a first end of the support line slidably connected to the yoke line and a second end of the support line connected to a worker harness, wherein the support line is extendable over a ridge line of the roof and is configured to:

connect to the worker; and at least partially support a weight of the worker.

2. The fall restraint as claimed in claim 1, further comprising a first clamp at the first end of the yoke line, and a second clamp at the second end of the yoke line.

3. The fall restraint as claimed in claim 2, wherein the clamp is a rebar hook and the two or more anchor lines each comprise steel vinyl coated cables.

4. The fall restraint as claimed in claim 1, wherein the yoke line is a polyester/polypropylene blend rope with one or more rebar hook ends and the support line is a polyester/polypropylene blend rope with manual rope adjustor.

5. The fall restraint as claimed in claim 1, wherein the yoke line and the support line are connected at a yoke.

6. The fall restraint as claimed in claim 5, wherein the yoke is selected from the group consisting of: a carabiner; a snap hook; and combinations thereof.

7. The fall restraint as claimed in claim 5, wherein the support line is configured to extend at an angle from a center axis of the roof.

8. The fall restraint as claimed in claim 7, wherein the angle is preferably between 0 and 41 degrees.

9. The fall restraint as claimed in claim 7, wherein the yoke line is configured to create a reduction in tension in the support line from a tension level at the center axis by means of a tangential force perpendicular to the support line.

10. The fall restraint as claimed in claim 9, wherein the reduction in tension is proportional to the cosine of the angle.

11. The fall restraint as claimed in claim 10, wherein the reduction in tension increases as the angle increases.

12. A fall restraint system for a worker, comprising:

a pitched roof having a first and second side defining a center axis;

a gutter connected to a lower edge of the first side of the pitched roof, the gutter having a first and second pre-existing gutter hanger;

a yoke line having: a first end releasably connected to the first pre-existing gutter hanger; and a second end releasably connected to the second pre-existing gutter hanger; and a support line having: a first end slidably connected to the yoke line; and a second end connected to a worker harness configured to be worn by the worker, wherein the support line travels from the first side of the roof to the second side of the roof and is configured to at least partially support a weight of the worker on the second side.

13. A fall restraint system for a worker, comprising:

a pitched roof having: a ridge; a center axis perpendicular to the ridge; a first side; and a second side, wherein the ridge extends between the first and second side and the first and second sides are angled downward from the ridge;

a gutter connected to a lower edge of the first side of the pitched roof, the gutter having a first and second pre-existing gutter hanger;

a first anchor line releasably connected to the first pre-existing gutter hanger;

a second anchor line releasably connected to the second pre-existing gutter hanger;

a yoke line having: a first end connected to the first anchor line; and a second end connected to the second anchor line; and a support line having: a first end slidably connected to the yoke line at a yoke; and a second end connected to a worker harness configured to be worn by the worker, wherein: the support line is configured to travel from the first side of the roof, over the ridge of the roof, to the second side of the roof and is configured to at least partially support a weight of the worker; and the yoke line is configured to create a reduction in tension in the support line from a tension level at the center axis by means of a tangential force perpendicular to the support line.

14. The fall restraint system as claimed in claim 13, wherein the support line extends at an angle from the center axis.

* * * * *